US006438249B1

(12) United States Patent
Wiener

(10) Patent No.: US 6,438,249 B1
(45) Date of Patent: Aug. 20, 2002

(54) OPEN BACK ACOUSTIC SPEAKER MODULE

(75) Inventor: David Wiener, Park City, UT (US)

(73) Assignee: SoundTube Entertainment, Inc, Park City, UT (US)

( * ) Notice: Subject to any disclaimer, the term of this patent is extended or adjusted under 35 U.S.C. 154(b) by 0 days.

(21) Appl. No.: 09/504,265

(22) Filed: Feb. 15, 2000

(51) Int. Cl.[7] ..... H04R 25/00
(52) U.S. Cl. ..... 381/388; 381/386; 381/388
(58) Field of Search ..... 381/86–87, 301–302, 381/306, 333–335, 386, 388–389, 365; 181/199, 141, 144, 170, 171; 379/430

(56) References Cited

U.S. PATENT DOCUMENTS

| | | | | | |
|---|---|---|---|---|---|
| 3,812,301 | A | * | 5/1974 | Lahti | |
| 4,179,009 | A | * | 12/1979 | Birkner | 181/171 |
| 4,828,910 | A | * | 5/1989 | Haussling | 428/284 |
| 4,874,908 | A | * | 10/1989 | Johansson | 174/72 A |
| 4,997,059 | A | * | 3/1991 | See | 181/172 |
| 5,016,934 | A | * | 5/1991 | Pelz | 296/214 |
| 5,280,991 | A | * | 1/1994 | Weiland | 296/214 |
| 5,309,634 | A | * | 5/1994 | Van Order et al. | 29/863 |
| 5,523,524 | A | | 6/1996 | Prokisch et al. | 181/156 |
| 5,699,438 | A | * | 12/1997 | Smith et al. | 381/188 |
| 5,744,218 | A | * | 4/1998 | Barnes | 428/192 |
| 5,754,664 | A | * | 5/1998 | Clark et al. | 381/86 |
| 5,757,945 | A | * | 5/1998 | Sakamoto | 381/194 |
| 5,761,322 | A | | 6/1998 | Illingworth et al. | 381/188 |
| 5,771,304 | A | | 6/1998 | Van Den Thillart | 381/188 |
| 5,838,809 | A | * | 11/1998 | Sato et al. | 381/409 |
| 5,850,462 | A | * | 12/1998 | Sakamoto et al. | 381/405 |
| 5,901,231 | A | * | 5/1999 | Parrella et al. | 381/86 |
| 6,004,209 | A | * | 12/1999 | Katsumoto et al. | 463/30 |
| 6,023,516 | A | | 2/2000 | Rifkind | 381/301 |
| 6,176,346 | B1 | | 1/2001 | Wiener | 181/199 |

* cited by examiner

*Primary Examiner*—Curtis Kuntz
*Assistant Examiner*—P. Dabney
(74) *Attorney, Agent, or Firm*—David P Gordon; David S Jackson; Thomas A Gallagher

(57) ABSTRACT

An open back speaker module includes a speaker mounting element having a front face defining at least one sound transducer opening and a rim provided with a first set of electrical contacts, and at least one sound transducer for creating sound waves mounted to the sound transducer opening of the speaker mounting element. The open back speaker module is couplable to a structural element such that the speaker module and the structural element at least partially define a chamber behind the sound transducer. A receptacle or a gasket, couplable to the structural element and adapted to engage or be engaged by the speaker mounting element, may also be provided to help secure the open back speaker module to the structural element. The speaker module, receptacle, and the gasket are preferably flexible such that they may conform to any shaped of structural element. However, the speaker module and/or the receptacle may instead be rigidly formed and pre-shaped to conform to the shape of a specific structural element. Additionally, the front of the speaker mounting element may be provided with a plurality of undulations which increase flexibility and improve the acoustics of the speaker.

29 Claims, 7 Drawing Sheets

OPEN BACK ACOUSTIC SPEAKER MODULE

BACKGROUND OF THE INVENTION

1. Field of the Invention

This invention relates broadly to acoustic speakers. More particularly, this invention relates to open back acoustic speakers.

2. State of the Art

Acoustics of speaker design is well understood. In a conventional speaker system, a sealed air-volume is provided at the backside of the speaker driver or other sound transducer which serves to suppress radiation of acoustic energy emanating from the backside of the speaker, thereby improving sound quality.

Designing speakers which can be attached to unusually shaped surfaces is a challenge faced by acoustical system designers attempting to design sound systems for existing or pre-formed structures such as buildings and automobiles. Further, substantially shallow areas, such as between wall and ceiling studs, or a rear window shelf, dashboard, or door panel of an automobile, or on a piece of furniture, provide minimal space for speakers to be installed.

SUMMARY OF THE INVENTION

It is therefore an object of the invention to provide an open back acoustical speaker module which may be adapted to conform to substantially any shape of a structural element.

It is another object of the invention to provide an open back speaker module which when coupled to a structural element utilizes the structural element as a rear enclosure portion thereby forming a chamber behind a speaker driver.

It is a further object of the invention to provide an open back speaker module which may be adapted to be placed on flexible structures.

Another object of the invention is to provide an open back speaker module which can be quickly and easily assembled and installed into an existing or pre-formed structure without requiring significant modification to the structure.

In accord with these objects, which will be discussed in detail below, an open back speaker module includes a speaker mounting element having a front defining at least one sound transducer opening and a side having a rim provided with a first set of electrical contacts, and at least one electroacoustical sound transducer means for creating sound waves mounted in the sound transducer opening of the speaker mounting element. The open back speaker module is adapted to be coupled to a structural element such that the speaker module and the structural element define a chamber behind the sound transducer. A receptacle, couplable to the structural element and adapted to engage the rim of the speaker mounting element, may also be provided to help secure the open back speaker module to the structural element. Alternately, a gasket couplable to the structural element and adapted to engage the rim of the speaker mounting element may be provided. The receptacle or gasket may further be provided with a second set of electrical contacts attached such that when the rim of the speaker mounting element is engaged with the receptacle or gasket, the first set of electrical contacts conductively engage the second set of electrical contacts. The speaker module, the receptacle, and the gasket are preferably flexible such that they may conform to any structural element shape. However, any of the speaker module, the receptacle, or the gasket may instead be rigidly formed and pre-shaped to conform to the shape of a specific structural element. Additionally, the front of the speaker mounting element may be provided with a plurality of undulations which increase flexibility and improve the acoustics of the speaker.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
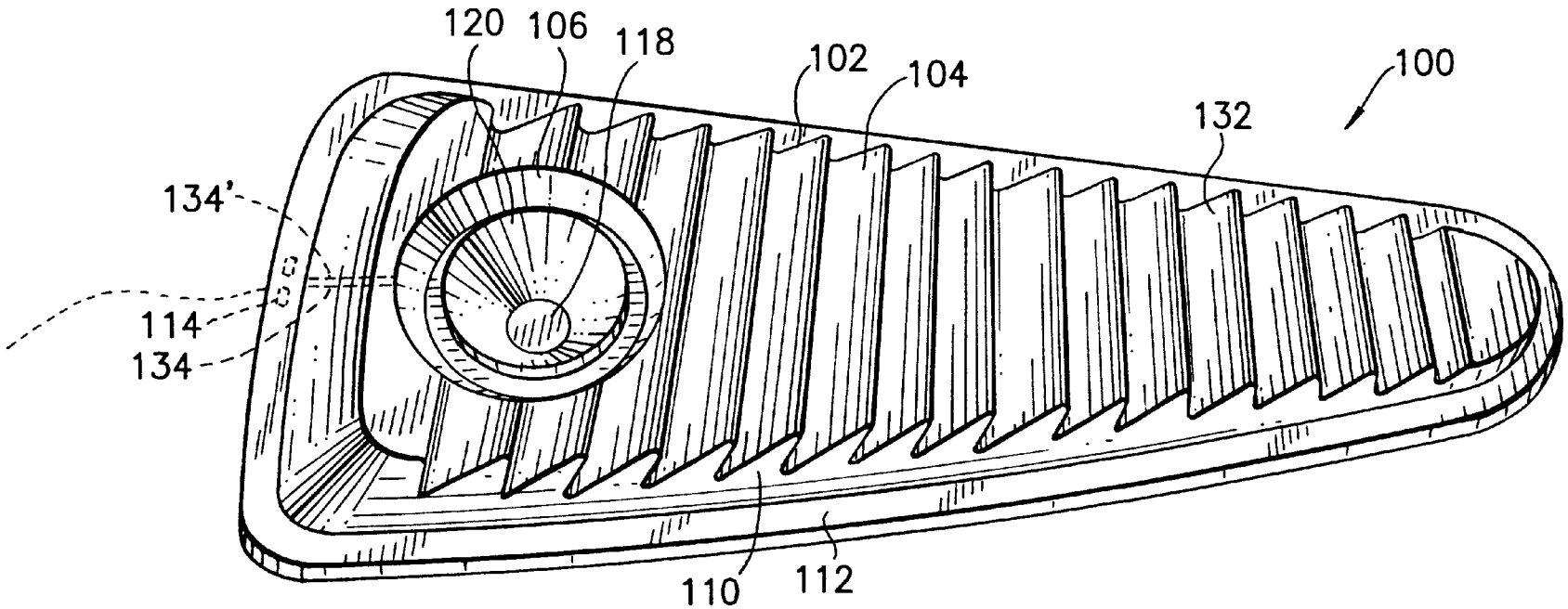
FIG. 1 is a perspective view of a first embodiment of an open back speaker module according to a first embodiment of the invention.
Figure 2:
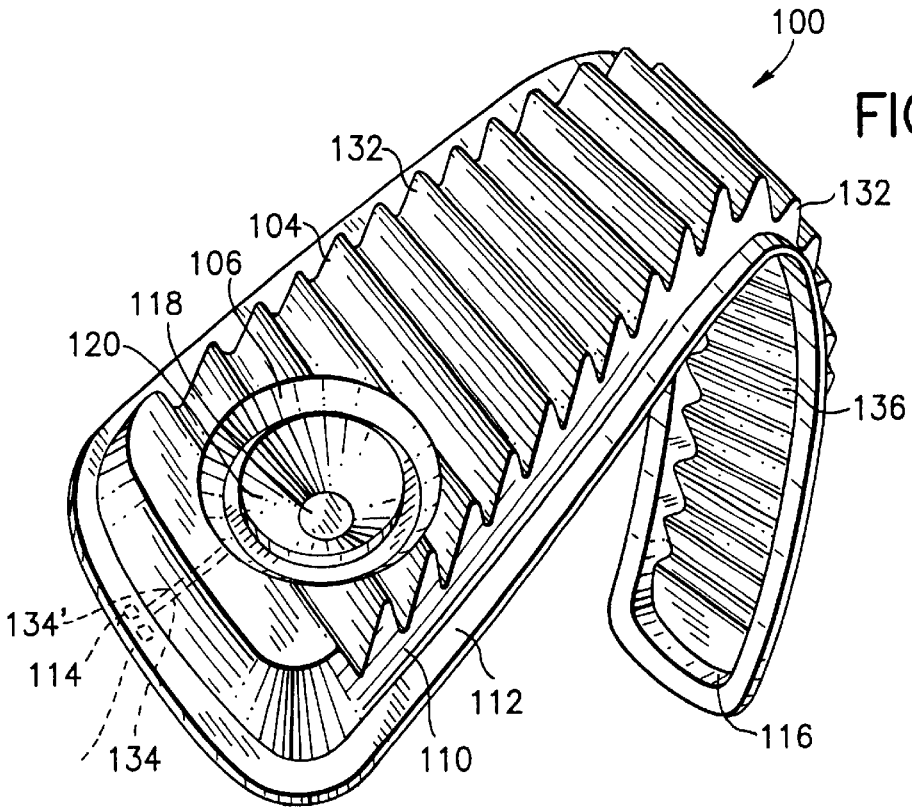
FIG. 2 is a perspective view of the open back speaker module of FIG. 1 shown in a flexed position.
Figure 3:
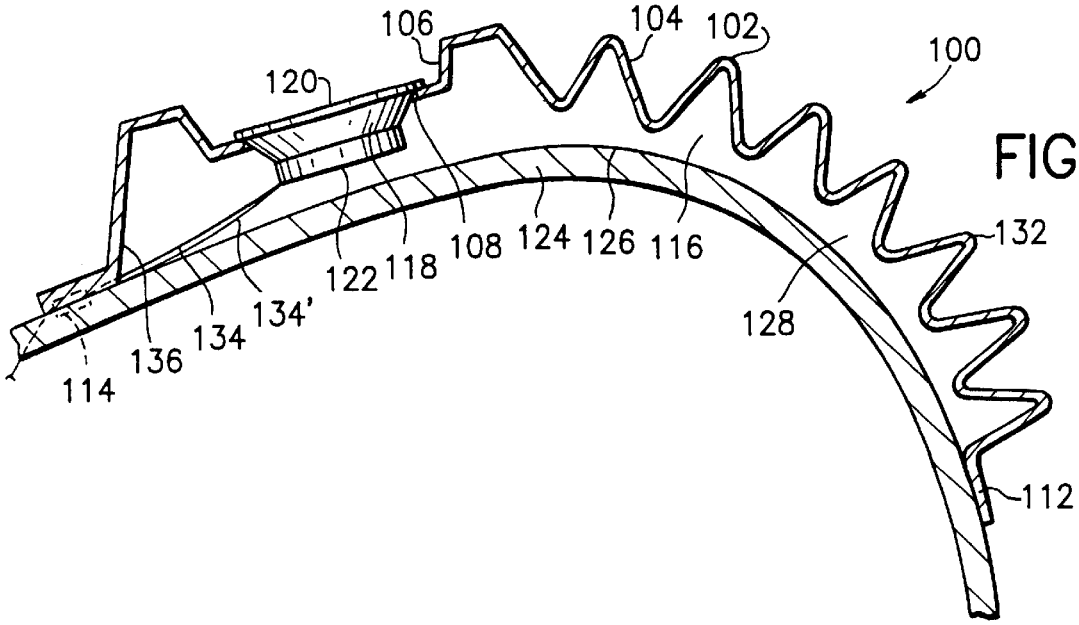
FIG. 3 is a broken side cross-sectional view of an open back speaker module coupled to a structural element.

Turning now to FIGS. 1, 2, and 3, a first embodiment of an open back speaker module 100 is shown including a speaker mounting element 102 having a front face 104 defining a recess 106 with a sound transducer opening 108 defined within the recess 106, and a side 110 having a rim 112 provided with a first set of electrical contacts 114. The front face 104 and side 110 define a substantially hollow cavity 116. Further, the speaker module 100 includes an electroacoustical sound transducer 118 having a front 120 and a rear 122 and is mounted in the sound transducer opening 108. The open back speaker module 100 is couplable to a structural element 124 having a surface 126. The rim 112 of the speaker module 100 and the surface 126 of the structural element 124 substantially form an enclosure around the cavity 116 such that the enclosure at least partially defines a chamber 128 behind the sound transducer 118. The sound transducer 118 creates sound waves and vibrations from both the front 120 and the rear 122 of the sound transducer 118. Sound emanating from the front 120 of the sound transducer 118 generally projects outward. Sound emanating from the rear 122 of the sound transducer 118 generally reverberates within the chamber 128 surrounding the rear 122 of the sound transducer 118. By using the structural element 124 as part of the speaker enclosure, structural redundancy is eliminated, space is preserved, and the size and dimensions of the speaker enclosure may be more easily adapted to fit on or within the irregularly shaped structure. The structural element 124 could be any rigid, flexible, or partially flexible structure including walls or ceilings within a building; a dashboard, door, seats, armrests or ceiling of an automobile interior; or furniture, clothing, or other personal effects such as hats, purses, bags or the like, etc. Where the flexible structure is not airtight, such as is often the case for clothing and other fabrics, an airtight film membrane can be laid over the flexible structure. The speaker module 100 may be coupled to the structural element 124 by any of various means such as adhesive, double-sided tape, snaps, pins, screws, clips, nails, snap-fit connection, friction fit, or hook and loop tape (Velcro®), etc. The speaker mounting element 102 itself is preferably flexible such that it may conform to any shaped structural element 124. However, the speaker mounting element 102 may instead be pre-formed from a rigid material to conform to a specific structural element 124. The speaker mounting element 102 may further be provided with a plurality of internal and external undulations 132 which define peaks and valleys. The undulations 132 provide many advantages. First, the curved surfaces of the undulations 132 help randomize the sound waves within the chamber 128 of the speaker module 100, thereby preventing the creation of standing waves within the chamber 128. Second, the undulations 132 provide additional strength to a rigidly formed speaker module and additional flexibility to a flexible speaker module.

The mounting element 102 may be formed from a unitary piece of material.

As seen in FIGS. 1, 2, and 3, the sound transducer 118 is electrically connected to the first set of electrical contacts 114 via wires 134, 134', which may be run along the backside 136 of the front face 104 and side 110 surface or may instead be loosely suspended within the cavity 116. Alternately, the wires 134, 134' may be molded into the speaker mounting element 102. The first set of electrical contacts 114 are adapted to be electrically connected to wires or jacks which in turn connect to an amplifier some distance away.

Figure 4:
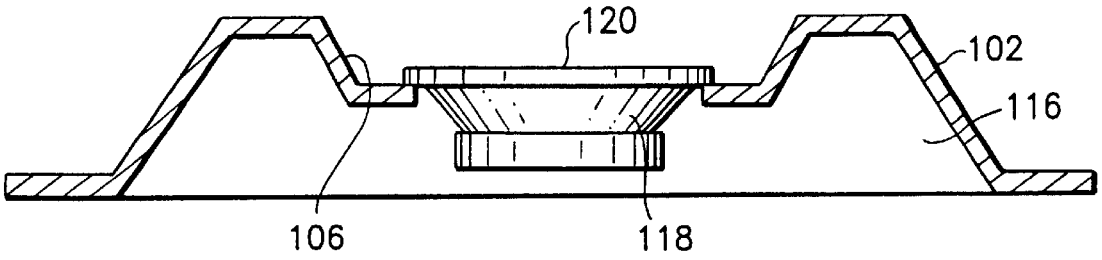
FIG. 4 is a cross-sectional view of an open back speaker module having an outward facing sound transducer mounted to the speaker module.
Figure 5:
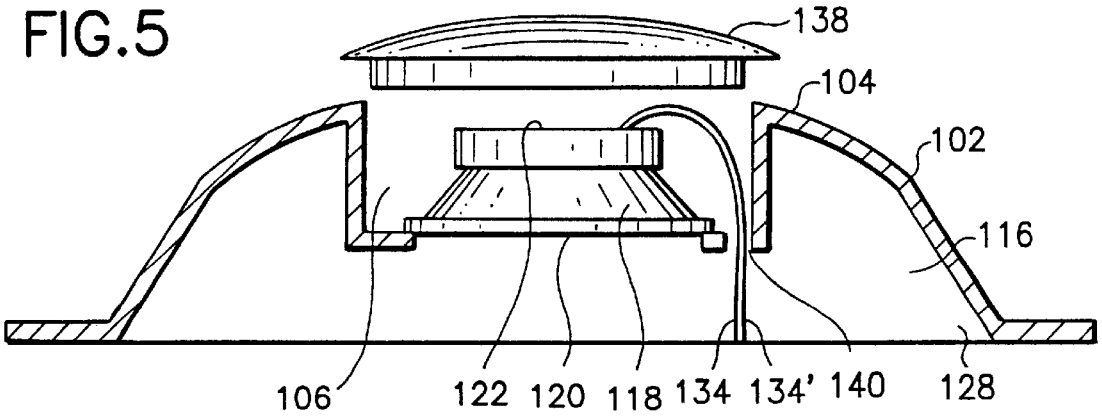
FIG. 5 is a cross-sectional exploded view of an open back speaker module having an inward facing sound transducer mounted to the speaker module.

Turning now to FIGS. 4 and 5, the sound transducer 118 may be mechanically coupled to the speaker mounting element 102 such that the front 120 of the sound transducer 118 faces outward (as shown in FIG. 4) or inward (as shown in FIG. 5). For inward facing sound transducers 118 as shown in FIG. 5, which are particularly designed to be used on clothing and provide a vibratory sensation to the wearer, the front face 104 of the speaker mounting element 102 is raised slightly in order that the recess 106 of the sound transducer opening 108 may be formed deeper to fully accommodate the sound transducer 118 without reducing the size of the cavity 116. A cap 138 may be inserted into the recess 106, thereby enclosing the rear 122 of the sound transducer 118 and diffusing or muffling the soundwave vibrations emanating from the rear 122 of the sound transducer 118. Further, the wires 134, 134' exiting the rear 122 of the sound transducer 118 may be run through a first wire aperture 140 defined by the speaker mounting element 102 and into the chamber 128 where they may be electrically coupled to the first set of speaker contacts (as shown in FIG. 1).

Figure 6:
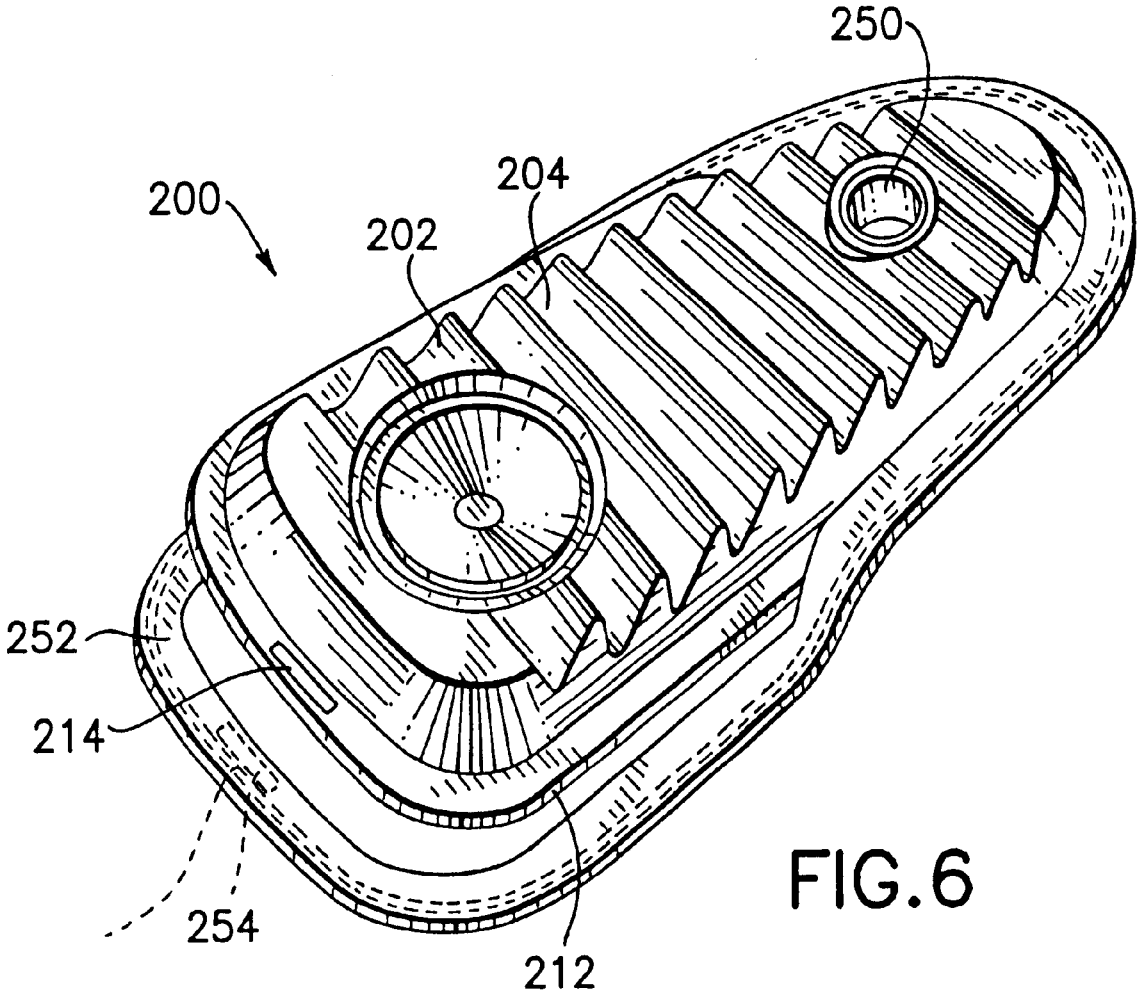
FIG. 6 is a partially exploded perspective view of an open back speaker module according to a second embodiment of the invention wherein the speaker module is partially engaged by a receptacle which is coupled to the structural element.
Figure 7:
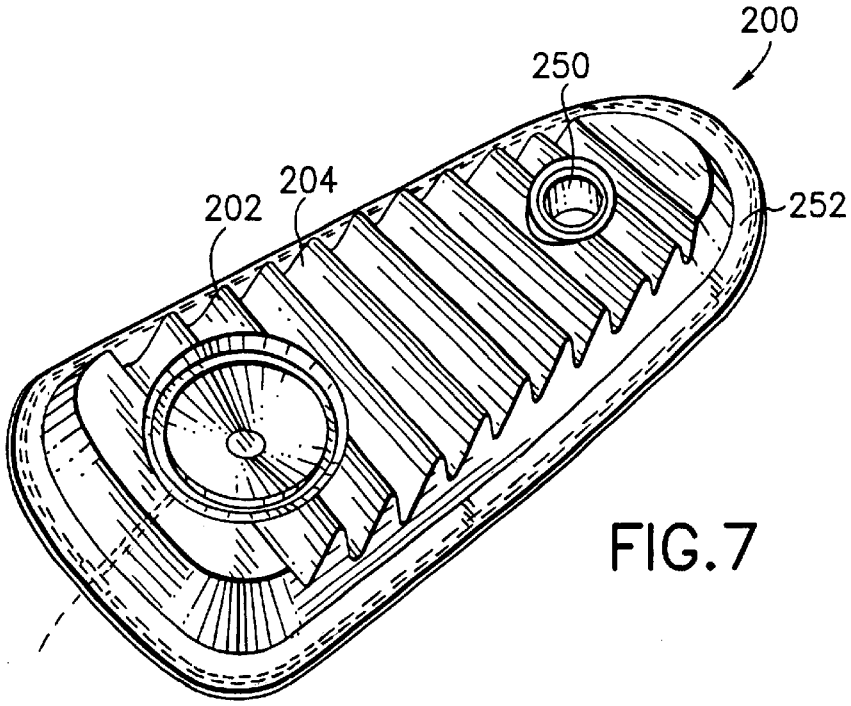
FIG. 7 is a perspective view of the open back speaker module of FIG. 6 completely engaged by the receptacle.
Figure 8:
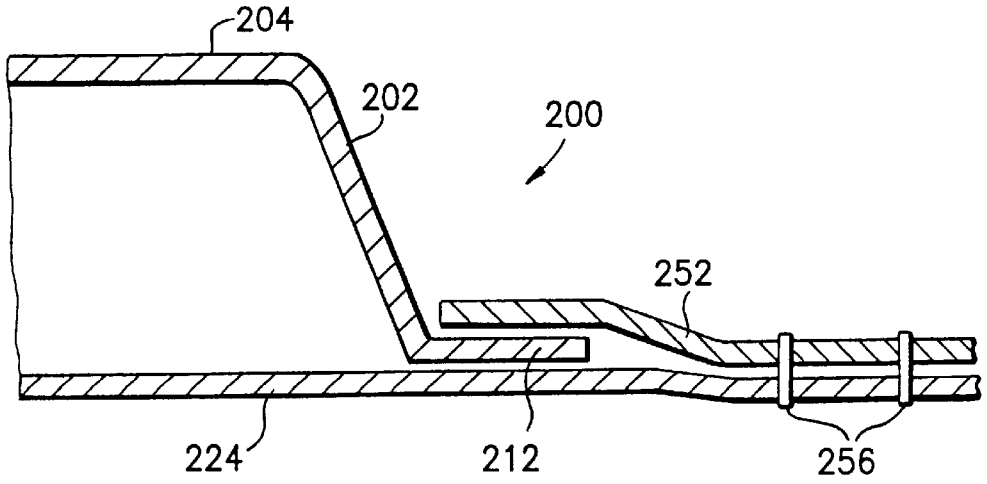
FIG. 8 is a broken cross-sectional view of an open back speaker module engaged within a receptacle according to the second embodiment.

Turning now to FIGS. 6, 7, and 8, a second embodiment of an open back speaker module 200, substantially similar to the speaker module of the first embodiment (with like parts having numbers incremented by 100), is shown. In the second embodiment 200, the front 204 of the speaker mounting element 202 defines both a sound transducer opening (shown in FIG. 4) and a sound port 250 which is used for the forward dispersion of sound. Further, the second embodiment 200 of the open back speaker module 200 includes a receptacle 252, which is adapted both to couple to a structural element 224 and to engage the rim 212 of the speaker mounting element 202, thereby securing it to the structural element 224. The receptacle 252 is preferably provided with a second set of electrical contacts 254 attached such that when the rim 212 of the speaker mounting element 202 is engaged with the receptacle 252, the first set of electrical contacts 214 conductively engages the second set of electrical contacts 254. The second set of electrical contacts 254 are used for electrical connection to the amplifier located elsewhere. The second set of contacts are provided so that electrical connections may be quickly, easily, and effectively made when the speaker mounting element 202 is detached from the structural element 224 (e.g. when laundering the structural) thereby eliminating the need to disconnect and reconnect wires. The receptacle 252 is preferably flexible to conform to the shape of different structural elements 224 and such that it may be manipulated to receive the rim 212 of the speaker module 200. However, the receptacle 252 may instead be pre-formed from a rigid material to conform to the shape of a specific structural element 224.

Referring now specifically to FIG. 8, the open back speaker mounting element 202 of the second embodiment is shown held securely within the receptacle 252 to the structural element 224. The receptacle 252 is secured to the structural element 224 (e.g. clothing or upholstery) by a double row of reinforced stitches 256. Alternately, the receptacle 252 may be secured to the structural element 224 by adhesive, double sided tape, snaps, pins, screws, clips, or hook and loop tape, or the receptacle 252 may be integrally formed with the structural element 224. In any event, the receptacle 252 may be formed of, or covered with a material which matches the structural element 224.

Figure 9:
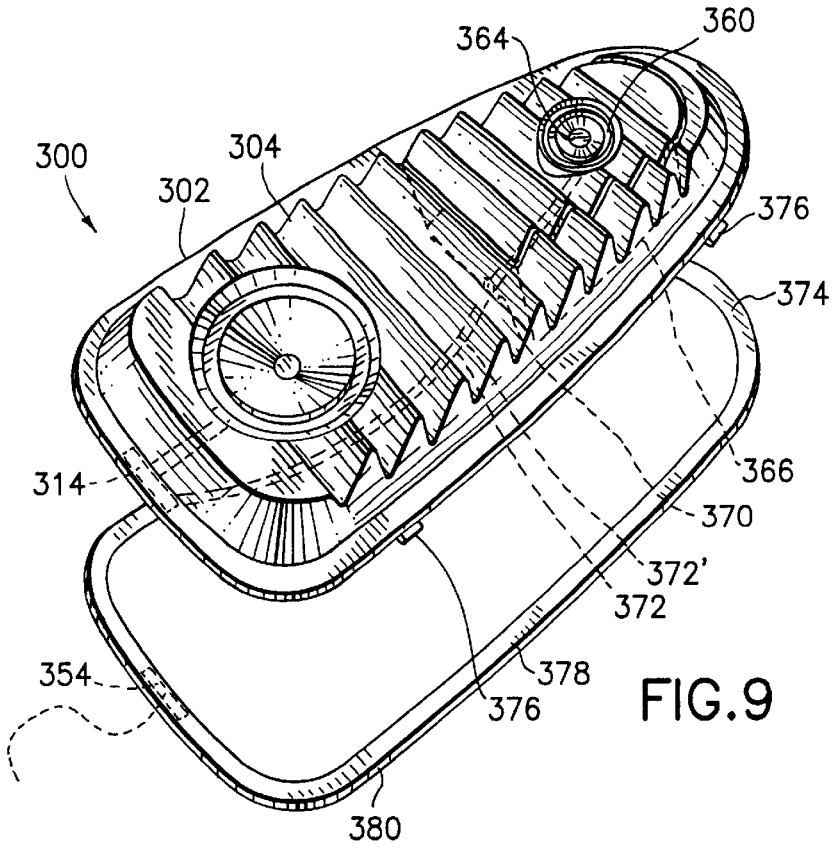
FIG. 9 is an exploded perspective view of an open back speaker module according to a third embodiment of the invention wherein the speaker mounting element is adapted to engage a gasket which is coupled to the structural element.
Figure 10:
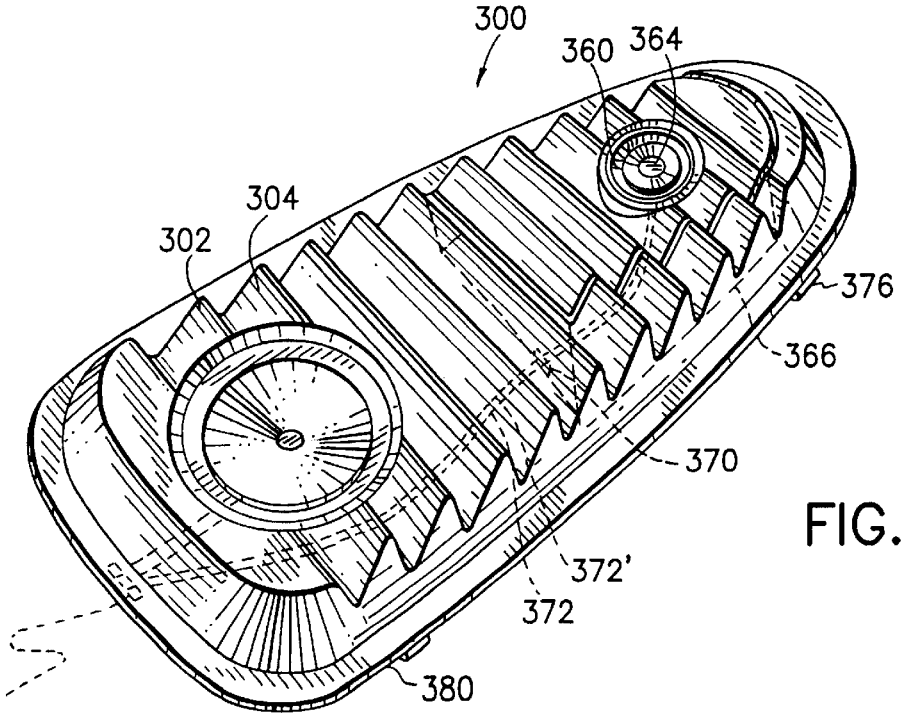
FIG. 10 is a perspective view of an open back speaker module according to FIG. 9 coupled to the gasket.
Figure 11:
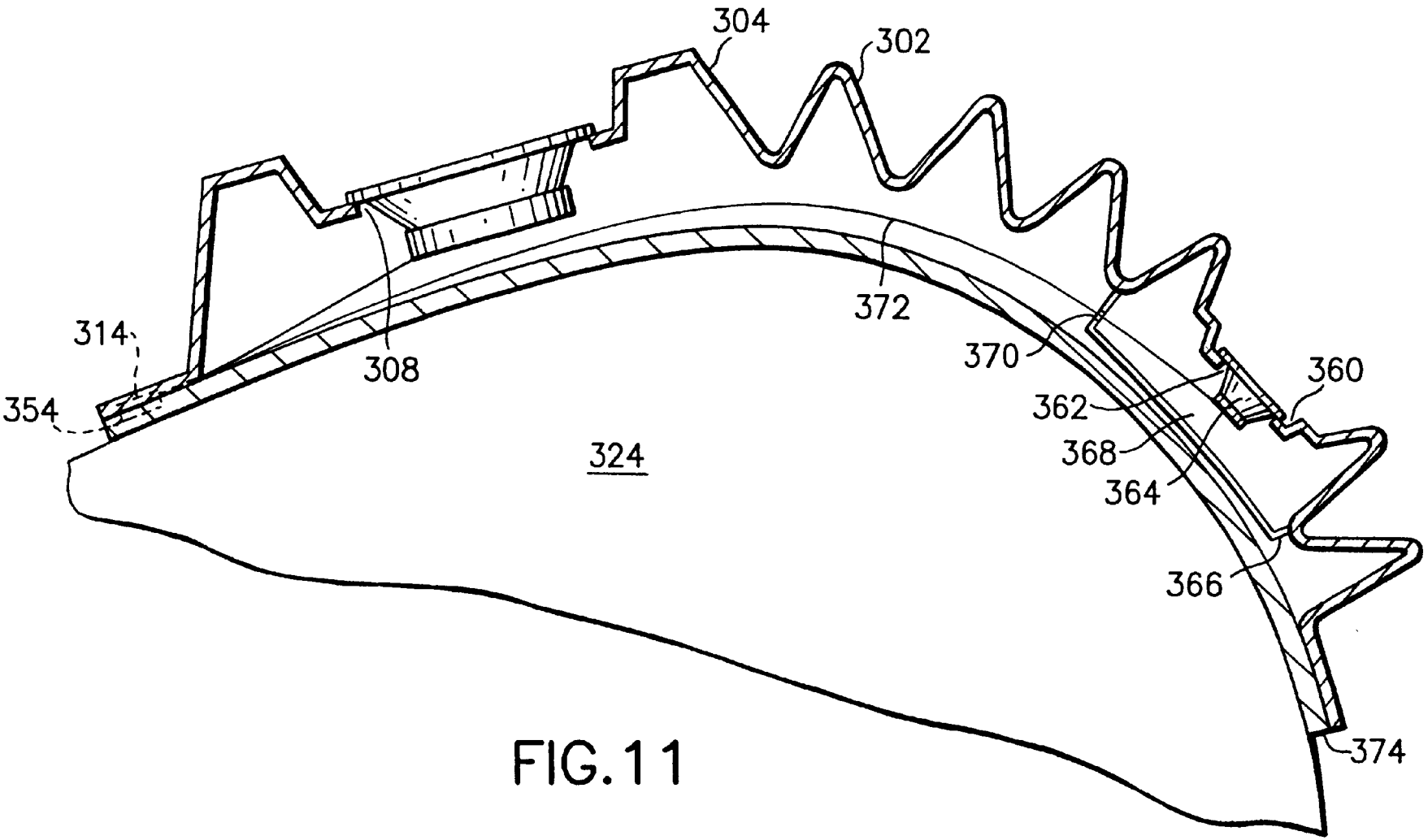
FIG. 11 is a broken side cross-sectional view of an open back speaker module according to the third embodiment coupled to a structural element.

Turning now to FIGS. 9, 10 and 11, a third embodiment of an open back speaker module 300, substantially similar to the speaker module of the first embodiment (with like parts having numbers incremented by 200), is shown. In addition to the sound transducer opening 308, the front face 304 of the speaker mounting element 302 defines a second recess 360 and a second sound transducer opening 362 defined within the second recess 360, and has a second sound transducer 364 mounted within the sound transducer opening 362. When a second sound transducer 364 is provided, the speaker mounting element 302 is preferably provided with a walled enclosure 366 which defines a second chamber 368 at least partially surrounding the second sound transducer 364 and having a second wire aperture 370 through which a second set of wires 372, 372' run from the second sound transducer 364 to the first set of electrical contacts 314 on the speaker mounting element 302. The first set of wire 334, 334' also attach to the first set of electrical contacts 314. The third embodiment 300 further includes a gasket 374 which attaches and preferably seals to the structural element 324. The speaker mounting element 302 engages the gasket 374 such that the first set of electrical contacts 314 on the speaker mounting element 302 conductively engage an optional second set of electrical contacts 354 on the gasket 374. The gasket 374 may be secured to the structural element 324 by adhesive, double sided tape, snaps, pins, screws, clips, snap-fit connection, hook and loop tape, or otherwise. Alternately, the gasket may be integrally formed with the structural element 324. Likewise, the speaker mounting element 302 may be coupled to the gasket 374 by adhesive, double sided tape, snaps, pins, screws, clips, hook and loop tape, or otherwise. However, according to the preferred embodiment, the speaker mounting element 302 is coupled to the gasket 374 by a plurality of snap fit connectors 376 engaging a lip 378 formed on an edge 380 of the gasket 374. The gasket 374 is preferably flexible to conform to the shape of different structural elements 324 and such that it may be manipulated to receive the speaker module 300. However, the gasket 374 may instead be pre-formed from a rigid material to conform to the shape of a specific structural element 324.

It should be appreciated by those skilled in the art, that all of the described embodiments are easily and inexpensively manufacturable. In addition, all external elements of the speaker module may easily be provided with designs molded into the elements or otherwise provided on the elements.

There have been described and illustrated herein several embodiments of an open back speaker module. While particular embodiments of the invention have been described, it is not intended that the invention be limited thereto, as it is intended that the invention be as broad in scope as the art will allow and that the specification be read likewise. Thus, while a particular speaker mounting element shape has been disclosed, it will be appreciated that the speaker mounting element may be formed in other shapes as well. While the speaker mounting element was disclosed having a side with a rim, it will be appreciated that the speaker mounting element may be formed without the rim, without sides, or with the rim on another part of the speaker mounting element. While it is preferable that the first set of electrical contacts are provided on the rim, it will be appreciated that the electrical contacts may be provided elsewhere on the speaker mounting element and preferably on a surface of the speaker mounting element. Further, while it is preferable to have the electrical contacts on the speaker mounting element, it will be appreciated that no electrical contacts need be provided thereon. Still further, while it is preferable that the second set of electrical contacts are provided on either the receptacle or gasket, it will be appreciated no electrical contacts need be provided thereon. It will also be appreciated that the sound transducer is not limited to a cone speaker, but could be other electroacoustic transducers which function to reproduce sound such as a flat panel transducer, a dome-shaped transducer, etc. Further, while the speaker mounting element provides a recess for mounting the sound transducer, it will be appreciated that no recess need be provided. Furthermore, while one or two sound transducers are shown, it will be understood that additional sound transducers can be similarly used. Further, it will be appreciated that the speaker mounting element may be formed having a separate chamber for each sound transducer. Likewise, while embodiments have been disclosed having no sound ports or one sound port, it will be understood that the speaker mounting element may instead define multiple sound ports. It will also be appreciated that the sound ports may be defined either by the front of the speaker mounting element or by the side. Further, a sound port may be defined by the structural element. Also, while it is preferable that the speaker mounting element, and where utilized, the receptacle or the gasket, be formed from a relatively flexible material, it will be recognized that any of them may instead be formed from a relatively rigid material. Flexible materials may include but are not limited to various synthetic plastics, rubber, natural and man-made fibers, leather, metal mesh, etc. Rigid materials may include but are not limited to metal, wood, hard-plastics, etc. Moreover, while particular engagement mechanisms have been disclosed in reference to securing the speaker mounting element to the structural element, it will be appreciated that other engagement mechanisms could be used as well. It will therefore be appreciated by those skilled in the art that yet other modifications could be made to the provided invention without deviating from its spirit and scope as claimed.

What is claimed is:

1. A speaker module couplable to a structural element, said speaker module comprising:

a) a flexible open back speaker mounting element defining a cavity and having a front face defining at least a first sound transducer opening which opens into said cavity, said speaker mounting element and the structural element substantially forming a chamber substantially enclosing said cavity; and b) a first sound transducer means mounted in said first sound transducer opening of said speaker mounting element wherein said cavity and said chamber have a substantially same volume.

2. A speaker module according to claim 1, further comprising:

c) a receptacle coupled to the structural element and adapted to engage a rim of said speaker mounting element.

3. A speaker module couplable to a structure element, said speaker module comprising:

a) a flexible open back speaker mounting element defining a cavity and having a front face defining at least a first sound transducer opening which opens into said cavity, said speaker mounting element and the structural element substantially forming a chamber substantially enclosing said cavity;

b) a first sound transducer means mounted in said first sound transducer opening of said speaker mounting element; and c) a receptacle coupled to the structural element and adapted to engage a rim of said speaker mounting element, wherein said rim is provided with a first set of electrical contacts, said receptacle is provided with a second set of electrical contacts, said first set of electrical contacts are provided on a surface of said rim of said speaker mounting element and said second set of electrical contacts are provided on a surface of said receptacle such that when said rim of said speaker mounting element is engaged with said receptacle, said first set of electrical contacts conductively contact said second set of electrical contacts.

4. A speaker module according to claim 3, wherein:

said receptacle is substantially flexible.

5. A speaker module according to claim 3, wherein:

said receptacle is substantially rigid.

6. A speaker module according to claim 3, wherein:

said receptacle is integrally formed with the structural element.

7. A speaker module according to claim 1, further comprising:

c) a gasket coupled to the structural element and adapted to be engaged by said speaker element.

8. A speaker module according to claim 7, wherein:

said speaker mounting element is provided with a first set of electrical contacts and a plurality of clasps and said gasket is provided with a second set of electrical contacts and a lip, said clasps of said speaker mounting element are adapted to engage said lip of said gasket, said first set of electrical contacts are provided on a surface of said speaker mounting element and said second set of electrical contacts are provided on a surface of said gasket such that when said speaker mounting element is engaged with said gasket, said first set of electrical contacts conductively contact said second set of electrical contacts.

9. A speaker module according to claim 7, wherein:

said gasket is substantially flexible.

10. A speaker module according to claim 7, wherein:

said gasket is substantially rigid.

11. A speaker module according to claim 7, wherein:

said gasket is integrally formed with the structural element.

12. A speaker module couplable to a structural element said speaker module comprising:

a) a flexible open back speaker mounting element defining a cavity and having a front face defining at least a first sound transducer opening which opens into said cavity, said speaker mounting element and the structural element substantially forming a chamber substantially enclosing said cavity; and b) a first sound transducer means mounted in said first sound transducer opening of said speaker mounting element, wherein at least a portion of said front face of said speaker mounting element has an undulating form.

13. A speaker module according to claim 12, wherein:

said front face has an outer surface, and at least a portion of said outer surface of said front face has said undulating form.

14. A speaker module according to claim 1, wherein:

said speaker mounting element defines at least one sound port opening into said cavity.

15. A speaker system comprising:

a) an open back speaker mounting element defining a cavity and having a front face defining at least a first sound transducer opening which opens into said cavity;

b) a first sound transducer means mounted in said first sound transducer opening of said speaker mounting element; and c) a flexible structural element onto which said speaker mounting element is mounted such that said open back speaker mounting element and said structural element substantially define a chamber substantially enclosing said cavity, wherein said cavity and said chamber have a substantially same volume.

16. A speaker system according to claim 15, further comprising:

d) a receptacle coupled to said structural element and adapted to engage a rim of said speaker mounting element.

17. A speaker system comprising:

a) an open back speaker mounting element defining a cavity and having a front face defining at least a first sound transducer opening which opens into said cavity, b) a first sound transducer means mounted in said first sound transducer opening of said sneaker mounting element;

c) a flexible structural element onto which said speaker mounting element is mounted such that said open back speaker mounting element and said structural element substantially define a chamber substantially enclosing said cavity; and d) a receptacle coupled to the structural element and adapted to engage a rim of said speaker mounting element, wherein said rim is provided with a first set of electrical contacts, said receptacle is provided with a second set of electrical contacts, said first set of electrical contacts are provided on a surface of said rim of said speaker mounting element and said second set of electrical contacts are provided on a surface of said receptacle such that when said rim of said speaker mounting element is engaged with said receptacle, said first set of electrical contacts conductively contact said second set of electrical contacts.

18. A speaker system according to claim 15, further comprising:

d) a gasket mounted between said structural element, and said open back speaker element.

19. A speaker system according to claim 18, wherein:

said speaker mounting element is provided with a first set of electrical contacts and a plurality of engagement means, and said gasket is provided with a second set of electrical contacts and a lip, said engagement means of said speaker mounting element for engaging said lip of said gasket, said first set of electrical contacts are provided on a surface of said speaker mounting element and said second set of electrical contacts are provided on a surface of said gasket such that when said speaker mounting element is engaged with said gasket, said first set of electrical contacts conductively contact said second set of electrical contacts.

20. A speaker system comprising:

a) an open back speaker mounting element defining a cavity and having a front face defining at least a first sound transducer opening which opens into said cavity, at least a portion of said front face of said speaker mounting element having an undulating form;

b) a first sound transducer means mounted in said first sound transducer opening of said speaker mounting element; and c) a flexible structural element onto which said speaker mounting element is mounted such that said open back speaker mounting element and said structural element substantially define a chamber substantially enclosing said cavity.

21. A speaker system according to claim 15, wherein:

said speaker mounting element is substantially flexible.

22. An open back speaker module according to claim 15, wherein:

said speaker mounting element further defines a sound port.

23. A speaker module couplable to a structural element, said speaker module comprising:

a) an open back speaker mounting element defining a cavity and having a front face defining at least a first sound transducer opening which opens into said cavity, said speaker mounting element and the structural element substantially forming a chamber substantially enclosing said cavity, at least a portion of said front face of said speaker mounting element having an undulating form; and b) a first sound transducer means mounted in said first sound transducer opening.

24. A speaker module according to claim 23, further comprising:

one of a receptacle coupled to the structural element and adapted to engage a rim of said speaker mounting element, wherein said rim has a first surface which is provided with a first set of electrical contacts, said receptacle has a second surface which is provided with a second set of electrical contacts such that when said rim of said speaker mounting element is engaged with said receptacle, said first set of electrical contacts conductively contact said second set of electrical contacts, and a gasket coupled to the structural element and adapted to be engaged by said speaker mounting element, wherein said speaker mounting element has a first surface provided with a first set of electrical contacts and said gasket has a second surface provided with a second set of electrical contacts such that when said speaker mounting element is engaged with said gasket, said first set of electrical contacts conductively contact said second set of electrical contacts.

25. A speaker module according to claim 23, wherein:

said speaker mounting element defines at least one sound port opening into said cavity.

26. A speaker module couplable to a structural element, said speaker module comprising:

a) a structural element;

b) an open back speaker mounting element removably coupled to said structural element, said speaker mounting element defining a cavity and having a front face defining at least a first sound transducer opening which opens into said cavity and a rim having a first surface provided with a first set of electrical contacts, said speaker mounting element and said structural element substantially forming a chamber substantially enclosing said cavity, wherein said cavity and said chamber have a substantially same volume; and c) a first sound transducer means mounted in said first sound transducer opening and electrically coupled to said first set of electrical contact.

27. A speaker module according to claim 26, further comprising:

one of a receptacle coupled to the structural element and adapted to engage said speaker mounting element, wherein said receptacle has a second surface which is provided with a second set of electrical contacts such that when said speaker mounting element is engaged with said receptacle, said first set of electrical contacts conductively contact said second set of electrical contacts, and a gasket coupled to the structural element and adapted to be engaged by said speaker mounting element, wherein said gasket has a second surface which is provided with a second set of electrical contacts such that when said speaker mounting element is engaged with said gasket, said first set of electrical contacts conductively contact said second set of electrical contacts.

28. A speaker module according to claim 26, wherein:

at least a portion of said front face of said speaker mounting element has an undulating form.

29. A speaker module according to claim 26, wherein:

said speaker mounting element defines at least one sound port opening into said cavity.

* * * * *